US005611082A

United States Patent [19]

Bull

[11] Patent Number: 5,611,082

[45] Date of Patent: Mar. 18, 1997

[54] THERMALLY INSULATED GARMENT WITH DISPLACEABLE FEET-ENCLOSING SECTIONS

[76] Inventor: Garland E. Bull, Rte. 2, Box 1630, Dardanelle, Ark. 72834

[21] Appl. No.: 671,631

[22] Filed: Jun. 27, 1996

Related U.S. Application Data

[60] Provisional application No. 60/005,181 Oct. 12, 1995.

[51] Int. Cl.[6] ..... A41D 1/06

[52] U.S. Cl. ..... 2/79; 2/80

[58] Field of Search ..... 2/79, 80, 69, 81, 2/82, 83, 2, 227, 114, 69.5

[56] References Cited

U.S. PATENT DOCUMENTS

| | | | |
|---|---|---|---|
| 2,236,636 | 4/1941 | Young . | |
| 2,659,086 | 11/1953 | McGrath . | |
| 2,697,837 | 12/1954 | Goldman | 2/79 |
| 3,111,676 | 11/1963 | Artzt et al. | 2/83 |
| 3,329,972 | 7/1967 | Schwab et al. | 2/83 |
| 3,597,764 | 8/1971 | Povey . | |
| 3,798,676 | 3/1974 | Shanks et al. . | |
| 4,117,552 | 10/1978 | Simpson . | |
| 4,158,892 | 6/1979 | Gonzales . | |
| 4,178,637 | 12/1979 | Wrightson . | |
| 4,308,622 | 1/1982 | Maddron . | |
| 4,363,141 | 12/1982 | Doster . | |
| 4,475,253 | 10/1984 | Laveckis | 2/80 |
| 4,534,065 | 8/1985 | Comfort . | |
| 4,949,887 | 8/1990 | Holmes . | |

*Primary Examiner*—C. D. Crowder
*Assistant Examiner*—Gloria Hall
*Attorney, Agent, or Firm*—Robert R. Keegan; Head, Johnson & Kachigian

[57] ABSTRACT

There is disclosed thermally insulated outer garments for covering the head, torso, arms, and legs of the wearer or any portion thereof, and which also cover the feet of the wearer and the footwear on the feet of the wearer. In addition to providing conventional features of such garments, the insulated garments disclosed are arranged with a reclosable opening provided with a zipper or other device for each foot and leg of the wearer, such opening extending from the bottom of the leg and foot portion upward to the thigh portion so that the shoe and foot covering portions may be slipped off of the foot utilizing the reclosable slit opening and secured by appropriate means on the upper portion of the leg. This permits the wearer to walk about while keeping the foot portion of the insulated garment out of contact with the ground and without removing any separate parts of the garment. In one embodiment the garment has separate insulated leg and foot covering portions for each leg and foot, while in another embodiment the lower portion has a sleeping bag type configuration with a single insulated enclosure for both legs and both feet.

20 Claims, 3 Drawing Sheets

THERMALLY INSULATED GARMENT WITH DISPLACEABLE FEET-ENCLOSING SECTIONS

CROSS-REFERENCE TO RELATED APPLICATION

This application claims priority from copending provisional application Ser. No. 60/005181, filed Oct. 12, 1995.

BACKGROUND OF THE INVENTION

The present invention relates to thermally insulated outer garments of the type which cover the lower torso, the legs, and the feet of the wearer and, in some cases, may optionally cover portions of the head, arms, or hands of the wearer. Insulating materials and garments made of such materials have been developed which are generally effective in protecting the wearer from the cold in low temperature environments. Great demand is put on such garments when the wearer spends long times in an inactive status such as at outdoor sports events or situated in a blind for hunting birds or other wild game.

Particularly in these situations, a great problem almost always lies in maintaining a comfortable temperature level for the feet of the wearer. Frequently resort to insulated boots is used to supplement the main outer garment to deal with the problem of maintaining foot warmth. While insulated boots have been developed which are reasonably effective, they are very expensive and, even then, are not totally satisfactory when the wearer spends long periods in an inactive status.

According to the present invention, the foregoing disadvantages are overcome by providing a thermally insulating garment wherein highly effective insulating material covers not only the lower torso and legs of the wearer but also totally encloses the feet of the wearer together with whatever footwear is in use. In order to take care of the situation when the wearer wishes to walk about, the garment is arranged so that the shoe and foot covering portions are not totally removed, but rather are merely slipped off of the foot and secured on the upper portion of the leg utilizing a reclosable slit opening to remove and insert the foot with its footwear. Accordingly, the preferred embodiment of the garment has insulating and heat retaining properties similar to a sleeping bag while still allowing the wearer's lower legs to be easily released for walking and moving about, all without removing any separate parts of the suit.

There have been previous attempts to provide insulating garments with insulating and heat retaining properties similar to a sleeping bag, but these have not provided the advantages of the present invention. U.S. Pat. No. 3,798,676 to Shanks, et al., issued Mar. 26, 1974 (U.S. Cl. 2/69.5) shows an insulating bag structure that may be secured about the waist and which is provided with a side zipper so that a person can easily fit the tubular body about the legs and lower torso. This garment, however, does not allow any means for freeing the foot and leg of the wearer to render the wearer ambulatory other than by removing the garment. A similar arrangement is shown in U.S. Pat. No. 3,597,764 to Povey issued Aug. 10, 1971 (U.S. Cl. 2/69) in which there is no means provided to mobilize the wearer other than by completely removing the garment. U.S. Pat. No. 4,308,622 to Maddron, issued Jan. 5, 1982 (U.S. Cl. 2/79) shows an insulating body suit which does not extend to cover the feet and shoes of the wearer but which totally covers the wearer's arms and hands. A primary feature of the suit is that, near the elbow of the arm sleeve, is an elastic cuff and the suit is proportioned so that the wearer can withdraw from the hand covering portion of the sleeve and insert the hand and forearm through the cuff thereby having temporary free use of the hand and fingers. Provision is made for fastening the unused or vacated segment of the sleeve alongside the remaining upper sleeve segment by use of a fastening means to prevent the vacated sleeve segment from interfering with the manual task at hand. The arrangement of Maddron, or any obvious adaptation of it, would fail to address the problems solved by the present invention.

U.S. Pat. No. 2,236,636 to Young, issued Apr. 1, 1941 (U.S. Cl. 2/227) shows an improvement in trousers or slacks in which each leg of the garment can be unzipped along a vertical line to expose a limb for coolness and ventilation and which includes means for holding the trouser leg in an elevated position. The arrangement of Young is not intended to be, and is not capable of being, adapted to solve the problem of providing insulating garments with foot covering portions.

SUMMARY OF THE INVENTION

In addition to providing the features and advantages described above, it is an object of the present invention to provide a lower portion for a coverall body suit, or the like which does not terminate at the ankles of the wearer but, rather, includes a foot covering portion of insulating material wherein each leg of the garment is provided with a reclosable slit or opening arranged so that leg of the garment can be drawn forward off of the toe end of the wearer's foot while the back of the foot and lower leg exit through the opening thereby exposing the wearer's normal footwear to enable and facilitate pedestrian movement of the wearer.

It is another object of the present invention to provide a lower portion of a garment, such as a body suit or the like as described above, wherein there is a provision for securing the forward part of the foot covering portion of the garment to the thigh portion of the leg of the garment so that it does not encumber or interfere with walking motion or other activity of the wearer.

BRIEF DESCRIPTION OF THE DRAWINGS

Other objects and advantages of the invention will be apparent from consideration of the following description in conjunction with the appended drawings in which.

DETAILED DESCRIPTION OF THE INVENTION

Figure 1:
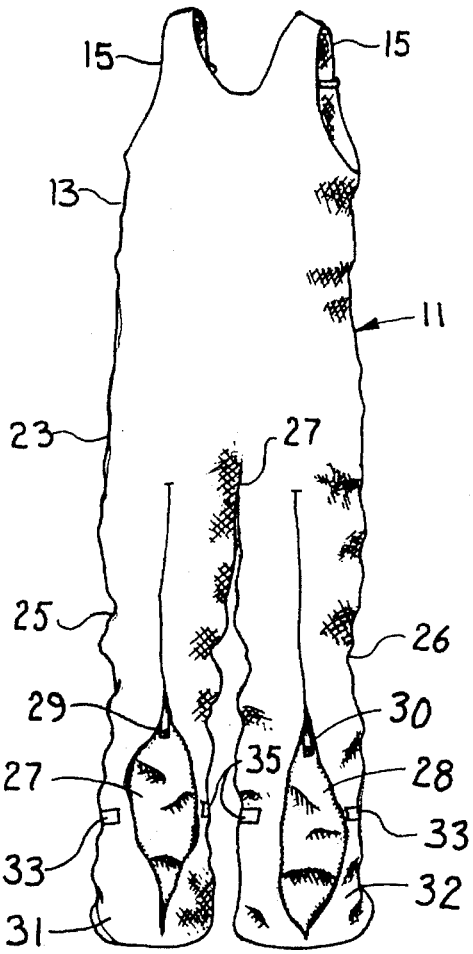
FIG. 1 is a rear perspective view of a garment showing the lower rear portion of the garment.
Figure 2:
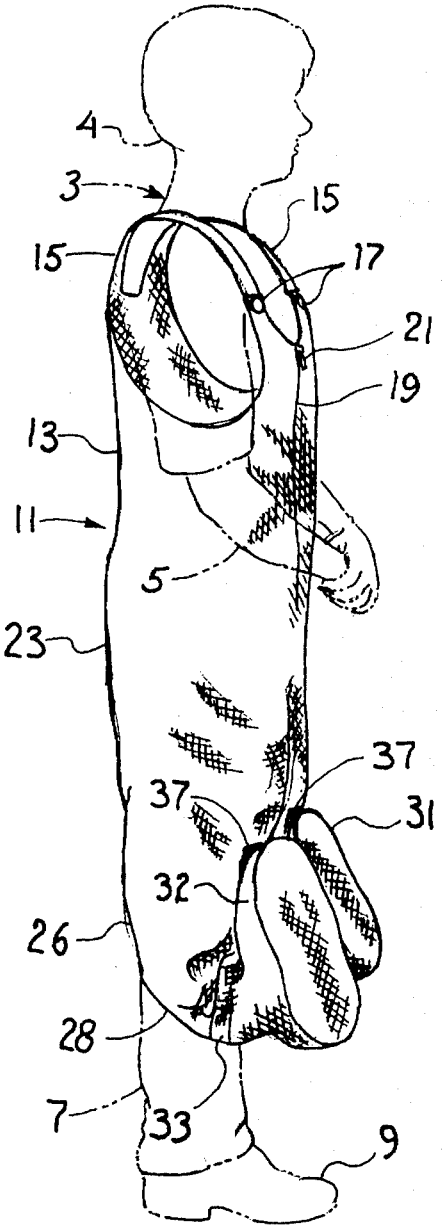
FIG. 2 is a side perspective view thereof with the position of a wearer indicated in phantom lines and having the foot covering portions removed from the shoes and secured in an upward position.
Figure 3:
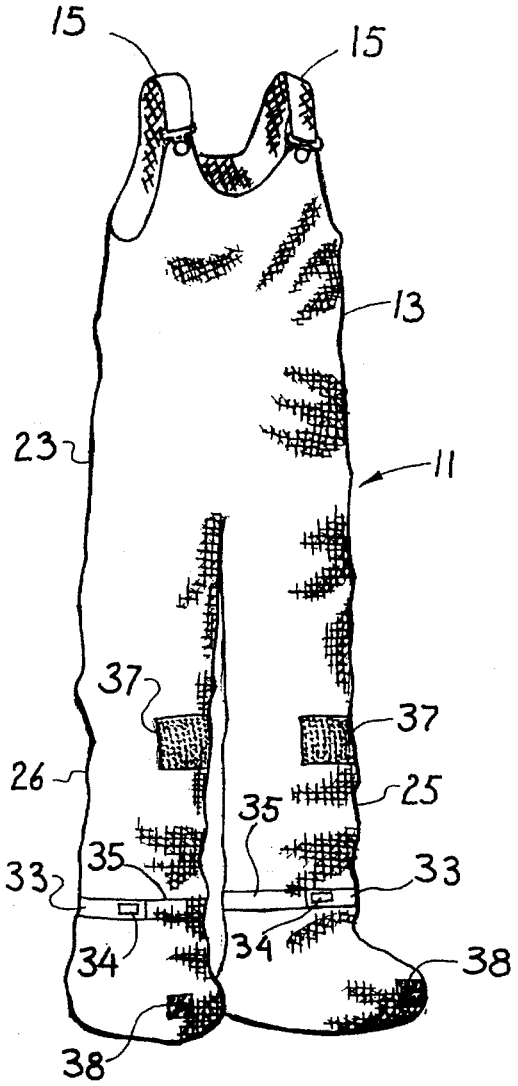
FIG. 3 is a front perspective view of the garment as shown in FIG. 1.
Figure 4:
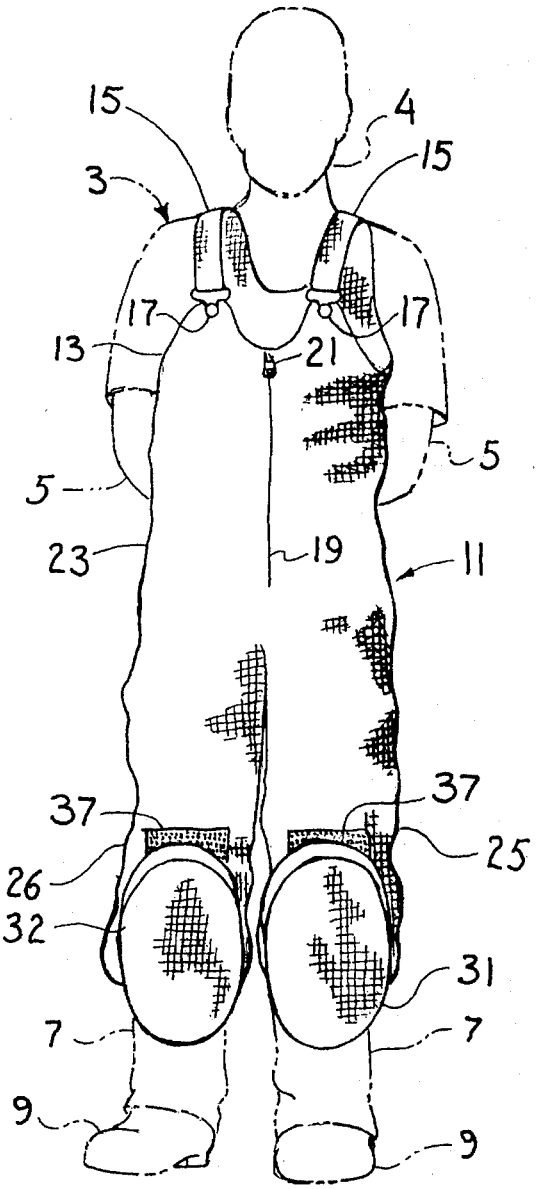
FIG. 4 is a front perspective view of the garment as shown in FIG. 2.

Referring now to the drawings, and particularly FIGS. 1–4, a thermally insulated suit 11 is shown in use as it would conform to the body (of the wearer 3 shown in phantom lines only in FIGS. 2 and 4). The suit 11 may be formed of double fabric insulating material employing down, fiber, foam or any of the known materials for garment insulation.

The suit 11 has an upper portion 13 which, in this embodiment, has a configuration similar to that of conventional bib overalls and, accordingly, has shoulder straps 15 which are secured at the front of the garment by conventional fasteners such as the traditional button and loop fasteners commonly used with overalls. Suit 11 would be used in conjunction with a conventional insulated jacket for full body protection.

A reclosable closure element in the form of a zipper 19 is provided extending down the front of the suit upper portion 13 to approximately the waist level and is fitted with a conventional zipper slide 21. Opening the zipper 19 with the slide 21 by moving it downward provides a wide opening for convenience in putting on the suit. This is accomplished in normal fashion by inserting the wearer's legs into the suit lower torso portion 23 and leg portions 25 and 26. This may be accomplished without removing the outer footwear 9 of the wearer 3 in a manner later to be described. Zipper 19 could be replaced with a VELCRO hook and loop fastener or any other suitable releasable fastening devices.

It is an important feature of the suit 11 according to the invention that the leg portions 25 and 26 are not terminated by small openings at the bottom through which the feet and outer footwear of the wearer pass but, rather, are provided with forwardly extending foot enclosure portions 31 and 32 formed of thermally insulating material generally similar to that of the remainder of the suit.

In the embodiments shown it is not intended, nor is it desirable, that foot enclosing portions 31 and 32 be in ground contact when the wearer 3 is walking from place to place, as they are not usually provided with wear resistant material to act as shoe soles. The suit of FIGS. 1–4 could be modified to provide wear resisting materials on the bottoms of foot enclosing portions 31 and 32 if desired and other embodiments of the invention may be so provided.

In FIG. 1 and in FIG. 3 the foot enclosing portions 31 and 32 are shown in the position that they would be when enclosing the feet and footwear of the wearer, whereas, in FIG. 2, these portions are shown deployed to an upper position allowing the wearer 3 to engage in pedestrian movement with boots or other footwear 9 in contact with the ground. In the embodiment of FIGS. 1–4 the two different positions of the foot enclosing portions 31 and 32 are accommodated by long slit-like openings 27 and 28 in the back of the legs 25 and 26 respectively, thereby allowing foot enclosures 31 and 32 respectively to be drawn off of the toe of the footwear 9 to release the feet and footwear of the wearer 3 for free and unencumbered movement without placing the foot enclosures 31 and 32 in contact with the ground. Openings 27 and 28 are preferably at least twelve inches long and extend to above the midpoint of leg portions 25 and 26. This is best shown in FIG. 3 where it may be seen that suitable fasteners 37 and 38 are provided for securing the foot enclosing portions 31 and 32 in the upper position as shown in FIGS. 2 and 4. Fasteners 37 and 38 are shown as VELCRO hook and loop fastener type fastening devices, but any hook, button, or other suitable form of fastener could be employed.

When the wearer 3 is in an inactive situation, such as seated at a sports event or in a hunting blind, the openings 27 and 28 would be closed by means of zippers 29 and 30 or other suitable means so that the heat retaining qualities of the leg portions 25 and 26 and the foot enclosure portions 31 and 32 would be maximized. When placing the wearer's legs 7 into the garment 11 it may be convenient to have foot enclosures 31 and 32 positioned upwardly as shown in FIGS. 2 and 4.

In order for the manipulation of the foot enclosure portions 31 and 32 on and off of the feet of the wearer 3 with facility, it is desirable that the legs 25 and 26 be somewhat longer than normal giving a baggy aspect to the suit 11. Therefore, it is desirable, as shown in FIG. 3, to provide straps 33 and 35, tie cords, or other banding means which can be drawn around the ankles of the leg portions 25 and 26 to prevent the foot enclosing portions 31 and 32 from sliding forward or off of the footwear 9. As shown in FIG. 3, these straps may be secured using tabs 34 of VELCRO hook and loop fastener or by any other suitable fastening means.

Figure 6:
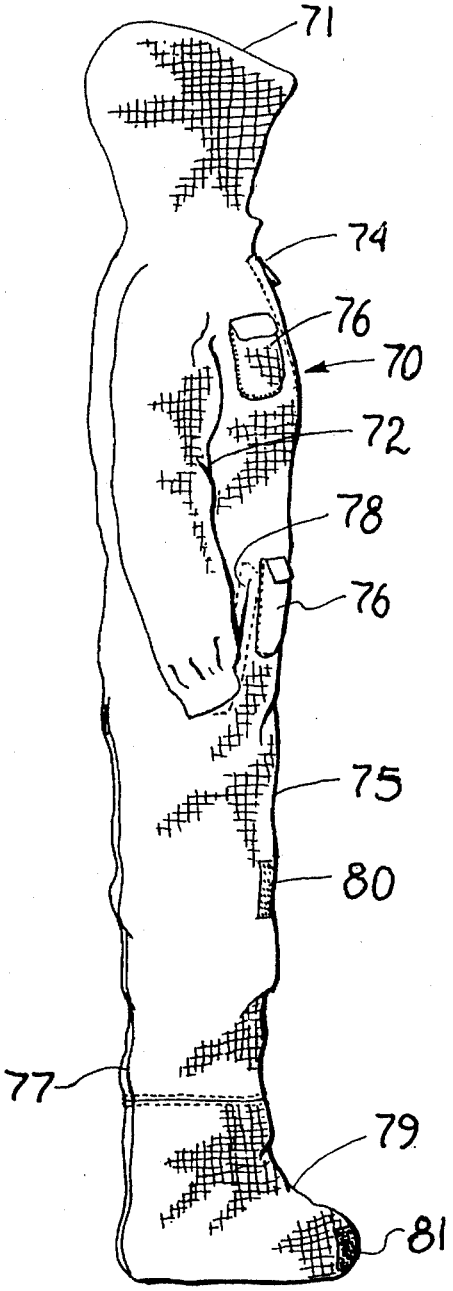
FIG. 6 is a right side elevational view of the alternative embodiment of FIG. 5.
Figure 5:
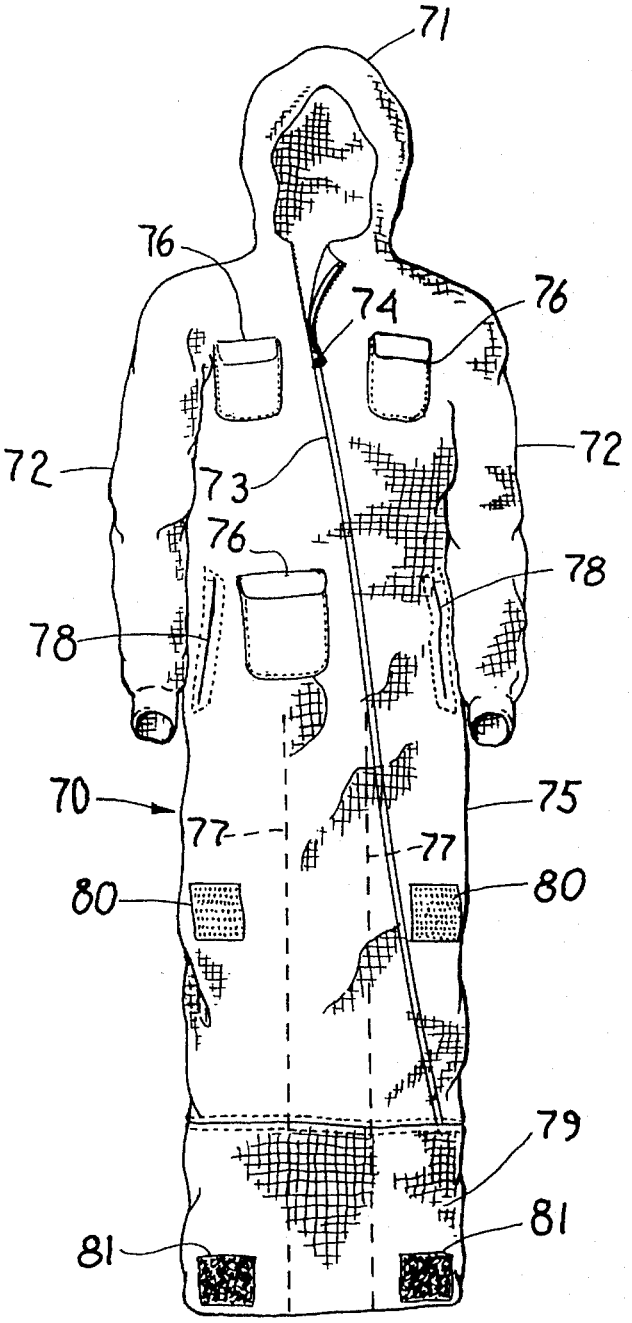
FIG. 5 is a front elevational view of an alternative embodiment of a thermally insulated suit according to the invention.

Referring now to alternative embodiments of the invention, particularly as shown in FIGS. 5 and 6, it should be understood that individual features or groups of features of the illustrated alternative embodiments may be incorporated in and used to modify the principal embodiment shown in FIGS. 1 through 4. Of course, all the features of one of the alternative embodiments, such as that shown in FIGS. 5 and 6, may be included in a body suit embodiment and, if desired, features of the principal embodiment of FIGS. 1 through 4 or other embodiments may be also incorporated.

Reference is now made to an alternative embodiment of the body suit of the invention as shown in FIGS. 5 and 6. Body suit 70 differs from previously described embodiments in that the lower portion of the suit 75 is not divided into separate leg portions and, thus, it is necessary as well as convenient for the wearer to uncover the feet in a manner similar to that described with respect to FIGS. 1–4 to achieve mobility while wearing the body suit 70. Body suit 70 is provided with a hood 71 of conventional form (which could be of the removable type if desired) and with full length sleeves 72. A zipper fastener 73 (or other suitable fastener) extends from near the neck of the garment to below the knee of the wearer and is provided with a conventional slide 74. As previously mentioned, the lower portion 75 of the body suit 70 is not divided into separate leg portions as in previously described embodiments. The body suit 70 may be provided with pockets 76 and 78 and the pockets 78 may or may not also allow access to the wearer's interior clothing and pockets therein.

Reclosable openings 77 are provided on the back of body suit lower portion 75 having the form and function similar to that shown for openings 27 and 28 of FIGS. 1 and 2. The foot covering portion 79 of the body suit 70 is formed substantially larger than the booted foot of any wearer and is preferably formed of extra heavy material. As will be apparent from FIGS. 5 and 6, the body suit 70 provides protection against cold weather environment substantially equivalent to a heavily insulated sleeping bag. At the same time, by utilizing reclosable openings 77 and fasteners to hold the foot enclosing portion well above the ground, the wearer easily can achieve substantial mobility adequate to move over short to moderate distances. Of course the full body form of suit of FIGS. 5 and 6 could be provided with the divided legs configuration of FIGS. 1–4, including a hood covering the wearer's head 4, if desired.

A further alternative embodiment of the invention may have a bib overall configuration similar to FIGS. 1–4 with a lower portion similar to FIGS. 5 and 6. Such a garment, like certain other embodiments, would be intended to be used with a conventional or special purpose insulated upper garment. If desired, the upper (bib)portion may be formed of material of lesser thickness with lower insulating quality than that of lower portion and foot enclosure portion. The upper bib and back portions of the FIGS. 1–4 configuration may be omitted, in which case a belt and/or suspenders may be provided to retain the legs and feet covering (pants like) garment at the wearer's waist.

Numerous other variations and modifications may be made to the embodiments specifically illustrated and described above. For example, the zippered or otherwise closed reclosable openings on the legs or lower portions of the body suits may be positioned on the inside rather than on the back as shown and such closures may be non-vertical and wrapped from side to back or vice versa to maximize convenience of operation by the wearer. The positions at which the foot portions are secured to free the feet for walking movement are highly variable and also great variation is possible in the type of fastener used to secure the foot portion including, but not limited to, belts, strings, elastic, buckles, tie cords, VELCRO hook and loop fastener, snaps, hooks, or the like. An inner or outer sole formed of solid or foam rubber, plastic, urethane or other material may be placed at the bottom of the foot area and the foot area may be rendered waterproof or water repellant by any suitable coating or waterproofing material. If desired the bottom of the leg and foot covering portion may be left partially open and means provided for securing the foot covering portion over the top of the wearer's boots while leaving the soles of the wearer's boots exposed for walking, thereby eliminating any substantial contact of the body suit garment with the ground (except possibly for a strap extending under the sole of the boot.) Pockets may be provided in the foot and leg covering portion of the suit to place conventional hand or foot warmer devices, which may be self-activated.

In addition to the variations and modifications to the invention which have been illustrated, described, or suggested, other modifications and variations will be apparent to those of skill in the art and the scope of the invention should be evaluated accordingly with reference to the appended claims.

What is claimed is:

1. An insulating garment for at least the lower body having a legs and feet-enclosing portion, said garment comprising;

a waist and hips covering first garment section formed of thermally insulating flexible fabric;

at least one thigh, knee, calf and foot covering elongated second garment section formed of thermally insulating flexible fabric and having a bottom extremity section forwardly extending and shaped to accommodate the shoes and feet of a wearer; said second garment section having a reclosable opening extending from near said bottom extremity section upwardly to at least about a midpoint of said second garment section, said opening being located to allow said bottom extremity section to be drawn forward from a toe end of the wearer's foot and shoe while the heel end of said foot and shoe passes through said opening; and fasteners located on an upper portion of said second garment section and at said bottom extremity section for securing said bottom extremity section out of proximity to the foot of the wearer;

whereby pedestrian movement is allowed without hindrance from or wear causing action on said bottom extremity section.

2. A garment as recited in claim 1 further including an upper body covering section with an elongated reclosable closure element for an opening extending downward from a top edge of said garment to a location near the waist and hips covering section of said garment.

3. A garment as recited in claim 2 wherein said upper body covering section consists of a bib type front and straps extending over the shoulders of a wearer from back to front and is without sleeves.

4. A garment as recited in claim 2 wherein said upper body covering section includes long sleeves.

5. A garment as recited in claim 2 wherein said upper body section includes a hood.

6. A garment as recited in claim 1 wherein said reclosable opening extends from a position at a rear lower part of said second garment section upwardly to a position at least twelve inches thereabove.

7. A garment as recited in claim 6 further including an upper body covering section with an elongated reclosable closure element for an opening extending downward from a top edge of said garment to a location near the waist and hips covering first garment section of said garment.

8. A garment as recited in claim 7 wherein said upper body covering section consists of a bib type front and straps extending over the shoulders from back to front and is without sleeves.

9. A garment as recited in claim 7 wherein said upper body covering section includes long sleeves.

10. A garment as recited in claim 7 wherein said upper body section includes a hood.

11. An insulating garment for the upper and lower body having a legs and feet-enclosing portion, said garment comprising:

an upper body covering first garment section;

a waist and hips covering second garment section formed of thermally insulating flexible fabric joined to said first garment section;

at least one thigh, knee, calf and foot covering elongated third garment section formed of thermally insulating flexible fabric and having a forwardly extending bottom extremity section shaped to accommodate shoes and feet of a wearer joined to said second garment section, said third garment section having at least one reclosable opening extending from near said bottom extremity section upwardly to at least about a midpoint of said third garment section, said opening being located to allow said forwardly extending bottom extremity section to be drawn forward from a toe end of the wearer's foot and shoe while the heel end of said foot and shoe passes through said opening; and first fastening means above said forwardly extending bottom extremity section and second cooperating fastening means at said forwardly extending bottom extremity section for securing said forwardly extending bottom extremity section above and out of proximity to the foot of the wearer thereby allowing pedestrian movement without hindrance from or wear causing action on said forwardly extending bottom extremity section.

12. A garment as recited in claim 11 wherein said upper body covering first garment section has an elongated reclosable closure element for an opening extending downward from a top edge of said garment to a location near the waist and hips covering second garment section of said garment.

13. A garment as recited in claim 12 wherein said upper body covering first garment section consists of a bib type front and straps extending over the shoulders of the wearer from back to front and is without sleeves.

14. A garment as recited in claim 12 wherein said upper body covering first garment section includes long sleeves and is formed of thermally insulating material.

15. A garment as recited in claim 12 wherein said upper body section includes a hood.

16. A garment as recited in claim 11 wherein said at least one reclosable opening extends from a position at a rear lower part of said third garment section upwardly to a position at least twelve inches thereabove.

17. A garment as recited in claim 16 wherein said second cooperating fastening means is located above a vertical midpoint of said elongated third garment section.

18. A garment as recited in claim 17 wherein said at least one thigh, knee, calf and foot-covering elongated third garment section includes two separated thigh, knee, calf and foot covering portions.

19. A garment as recited in claim 18 further including at least two banding means located on lower portions of said third garment section.

20. An insulating garment for the upper and lower body having a legs and feet-enclosing portions, said garment comprising:

an upper body and arms covering first garment section formed of thermally insulating flexible fabric;

a waist and hips covering second garment section formed of thermally insulating flexible fabric joined to said first garment section;

two separated thigh, knee, calf and foot covering elongated lower garment portions secured below said second garment section formed of thermally insulating flexible fabric joined to said second garment section and each having a forwardly extending bottom extremity section shaped to accommodate a shoe and foot of a wearer, each said elongated garment portion having a reclosable opening extending from near said bottom extremity section upwardly to at least about a midpoint of each said elongated lower garment portion, each said opening being located to allow the respective forwardly extending bottom extremity section to be drawn forward from a toe end of a wearer's foot and shoe while the heel end of said foot and shoe passes through said opening; and fastening means on an upper portion of each said lower elongated garment portion and at the respective forwardly extending bottom extremity section for securing each said forwardly extending bottom extremity section out of proximity to the foot of the wearer thereby allowing pedestrian movement without hindrance from or wear causing action on said forwardly extending bottom extremity sections.

* * * * *